US011431133B2

(12) United States Patent
Tang et al.

(10) Patent No.: US 11,431,133 B2
(45) Date of Patent: Aug. 30, 2022

(54) ELECTRICAL CONNECTOR WITH MULTIPLE SHIELD CONFIGURATIONS

(71) Applicant: DONGGUAN LEADER PRECISION INDUSTRY CO., LTD., Dongguan (CN)

(72) Inventors: Binquan Tang, Dongguan (CN); Xiaoqing Zhang, Dongguan (CN); Lijun Xu, Dongguan (CN)

(73) Assignee: DONGGUAN LEADER PRECISION INDUSTRY CO., LTD., Dongguan (CN)

( * ) Notice: Subject to any disclaimer, the term of this patent is extended or adjusted under 35 U.S.C. 154(b) by 0 days.

(21) Appl. No.: 16/921,308

(22) Filed: Jul. 6, 2020

(65) Prior Publication Data

US 2021/0305755 A1 Sep. 30, 2021

(30) Foreign Application Priority Data

Mar. 27, 2020 (CN) ..... 202020426244.7

(51) Int. Cl.
*H01R 13/6594* (2011.01)
*H01R 13/6582* (2011.01)
(Continued)

(52) U.S. Cl.
CPC ..... *H01R 13/6594* (2013.01); *H01R 13/6582* (2013.01); *H01R 24/60* (2013.01);
(Continued)

(58) Field of Classification Search
CPC ..... H01R 13/6594; H01R 24/60; H01R 13/6582; H01R 12/716; H01R 12/72;
(Continued)

(56) References Cited

U.S. PATENT DOCUMENTS

D737,211 S 8/2015 Little et al.
D867,301 S 11/2019 Saitou et al.
(Continued)

FOREIGN PATENT DOCUMENTS

CN 2682675 Y * 3/2005
CN 2753007 Y * 1/2006 ..... H01R 13/6581
(Continued)

OTHER PUBLICATIONS

LuxshareICT, "USB4.0 Gen3 24Pin Type connector," available from Internet, URL: https://en.luxshare-ict.com/content/details376_1966.html, Aug. 11, 2016, [online], 3 pages total.
(Continued)

*Primary Examiner* — Abdullah A Riyami
*Assistant Examiner* — Justin M Kratt
(74) *Attorney, Agent, or Firm* — Birch, Stewart, Kolasch & Birch, LLP

(57) ABSTRACT

The present disclosure discloses an electrical connector including an insulating body, a number of conductive terminals disposed in the insulating body, a metal inner shell enclosing the insulating body and a metal outer shell covering the metal inner shell. The metal inner shell includes a top wall, a bottom wall and two side walls connecting the top wall and the bottom wall so as to form a receiving space to mate with a mating connector. The metal outer shell includes a base portion and two side portions bent downwardly from two sides of the base portion. The top wall is provided with a rivet line, and the base portion is attached and welded to the top wall. The electrical connector of the present disclosure has a stable structure and is not easily damaged.

12 Claims, 9 Drawing Sheets

(51) Int. Cl.

| | |
|---|---|
| ***H01R 24/60*** | (2011.01) |
| *H01R 13/648* | (2006.01) |
| *H01R 13/6583* | (2011.01) |
| *H01R 13/6581* | (2011.01) |
| *H01R 13/658* | (2011.01) |
| *H01R 12/71* | (2011.01) |
| *H01R 12/72* | (2011.01) |

(52) U.S. Cl.
CPC ..... *H01R 12/716* (2013.01); *H01R 12/72* (2013.01); *H01R 12/724* (2013.01); *H01R 13/648* (2013.01); *H01R 13/658* (2013.01); *H01R 13/6581* (2013.01); *H01R 13/6583* (2013.01)

(58) Field of Classification Search
CPC ..... H01R 13/648; H01R 13/6583; H01R 13/658; H01R 13/6581; H01R 12/724
USPC ..... 439/660, 676
See application file for complete search history.

(56) References Cited

U.S. PATENT DOCUMENTS

| | | | | |
|---|---|---|---|---|
| 10,468,824 | B2 | 11/2019 | Lin et al. | |
| D921,592 | S | 6/2021 | Ueda | |
| D924,164 | S | 7/2021 | Shimomaki | |
| D937,218 | S | 11/2021 | Ueda | |
| 2005/0061642 | A1* | 3/2005 | James | H01R 13/501 200/51 R |
| 2005/0124217 | A1* | 6/2005 | Zhuang | H01R 12/7088 439/607.03 |
| 2010/0210124 | A1 | 8/2010 | Li | |
| 2015/0087172 | A1* | 3/2015 | Yu | H01R 13/6582 439/108 |
| 2015/0311645 | A1 | 10/2015 | Chang | |
| 2016/0043510 | A1* | 2/2016 | Peng | H01R 13/6581 439/620.21 |
| 2017/0187140 | A1 | 6/2017 | Tsai et al. | |
| 2018/0351287 | A1* | 12/2018 | Zhao | H01R 13/5219 |
| 2020/0136315 | A1 | 4/2020 | Tanaka | |
| 2021/0210896 | A1 | 7/2021 | Xu et al. | |
| 2021/0296817 | A1 | 9/2021 | Su | |
| 2021/0305755 | A1 | 9/2021 | Tang et al. | |

FOREIGN PATENT DOCUMENTS

| | | | | |
|---|---|---|---|---|
| CN | 2753007 Y | * | 1/2006 | |
| CN | 203135087 U | * | 8/2013 | H01R 13/6581 |

OTHER PUBLICATIONS

U.S. Office Action for U.S. Appl. No. 29/740,613, dated Mar. 16, 2022.

* cited by examiner

ELECTRICAL CONNECTOR WITH MULTIPLE SHIELD CONFIGURATIONS

CROSS-REFERENCE TO RELATED APPLICATION

This patent application claims priority of a Chinese Patent Application No. 202020426244.7, filed on Mar. 27, 2020 and titled "Electrical Connector", the entire content of which is incorporated herein by reference.

TECHNICAL FIELD

The present disclosure relates to a field of connectors, in particular relates to a field of electrical connectors with stable structure.

BACKGROUND

An existing Type C 3.1 connector includes an insulating body, a metal inner shell enclosing the insulating body and a metal outer shell. A riveting line of the metal inner shell is located at the bottom of the metal inner shell, and there is a large gap with respect to a SMT board surface. When existing connectors are mated with corresponding connectors, in case the external force (such as when the user's device falls) received by the connector exceeds the riveting force of the metal inner shell, the metal inner shell may crack, which easily causes damages to the connector. When the existing Type C 3.1 connector is assembled, the metal inner shell needs to be fixed to the insulating body by riveting and pressing. During this process, the metal inner shell and the metal outer shell are positioned by fixtures and then fixed by laser welding. However, this assembly process is complicated and has a risk that it is difficult to assemble due to the large deviation, which affects the assembly efficiency.

Therefore, it is necessary to provide a new electrical connector to solve the above problems.

SUMMARY

The purpose of the present disclosure is to provide an electrical connector which has a stable structure, is not easily damaged and improves the product yield.

In order to achieve the above purpose, the present disclosure adopts the following technical solution: an electrical connector adapted to be mounted on a printed circuit board. The electrical connector includes an insulating body, a plurality of conductive terminals disposed in the insulating body, a metal inner shell enclosing the insulating body and a metal outer shell covering the metal inner shell. The metal inner shell includes a top wall, a bottom wall and two side walls connecting the top wall and the bottom wall so as to form a receiving space to mate with a mating connector. The metal outer shell includes a base portion and two side portions bent downwardly from two sides of the base portion. The top wall is provided with a rivet line, and the base portion is attached and welded to the top wall.

As a further improved technical solution to the present disclosure, the metal inner shell includes a supporting leg bent downwardly. One end of the supporting leg is connected to the bottom wall and the other end is punched to form a free end with the bottom wall. The free end of the supporting leg abuts against an upper surface of the printed circuit board.

As a further improved technical solution to the present disclosure, the two side portions are located outside of the two side walls and each side portion includes a mounting leg extending downwardly to be mounted to the printed circuit board. The free end of the supporting leg is higher than an end portion of the mounting leg.

As a further improved technical solution to the present disclosure, one of the side wall and the side portion is provided with a buckle protrusion, and the other of the side wall and the side portion is provided with an opening to receive the buckle protrusion so that the metal inner shell and the metal outer shell are positioned.

As a further improved technical solution to the present disclosure, the insulating body includes a recess provided on each side thereof, and the side walls of the metal inner shell are provided with a pair of elastic arms protruding toward the insulating body and elastically abutting against the two recesses, respectively.

As a further improved technical solution to the present disclosure, the side wall of the metal inner shell includes a bottom plate bent inwardly from a bottom edge of the side wall. The bottom plate is located behind the bottom wall. The insulating body includes a tongue plate and a body portion extending rearwardly from the tongue plate. The thickness of the body portion is greater than the thickness of the tongue plate. The distance between the bottom plate to the top wall is greater than the distance between the bottom wall and the top wall. The bottom wall is located below the tongue plate. The bottom plate abuts against a lower side of the body portion.

As a further improved technical solution to the present disclosure, a plurality of grooves are formed between the tongue plate and the body portion. Each of the top wall and the bottom wall of the metal inner shell is provided with a plurality of arched portions protruding into the receiving space. The arched portions are received in the grooves.

As a further improved technical solution to the present disclosure, the insulating body includes a first insulating portion and a second insulating portion on which the first insulating portion is stacked. The conductive terminals include a plurality of first conductive terminals disposed in the first insulating portion and a plurality of second conductive terminals disposed in the second insulating portion. Two outer sides of the first insulating portion are provided with a pair of first hook portions extending toward the second insulating portion. Two outer sides of the second insulating portion are provided with a pair of second hook portions extending toward the first insulating portion. The first hook portions and the second hook portions are engaged with each other.

As a further improved technical solution to the present disclosure, a head of each first hook portion is provided with an oblique first guide portion. A head of each second hook portion is provided with an oblique second guide portion. The oblique first guide portion and the oblique second guide portion cooperate with each other so that the first hook portions and the second hook portions can be guided and engaged with each other.

As a further improved technical solution to the present disclosure, the first insulating portion includes a rear stop portion extending downwardly from a tail end thereof and abutting against a rear side of the second insulating portion. An accommodation space is formed between the first hook portion and the rear stop portion. The second insulating portion is partially embedded in the accommodation space.

Compared with the prior art, the electrical connector of the present disclosure is provided with a metal inner shell having a riveting line formed on the top wall, thereby avoiding the risk of cracking of the metal inner shell, ensuring the structure of the electrical connector is stable and not easily damaged.

DETAILED DESCRIPTION

Figure 1:
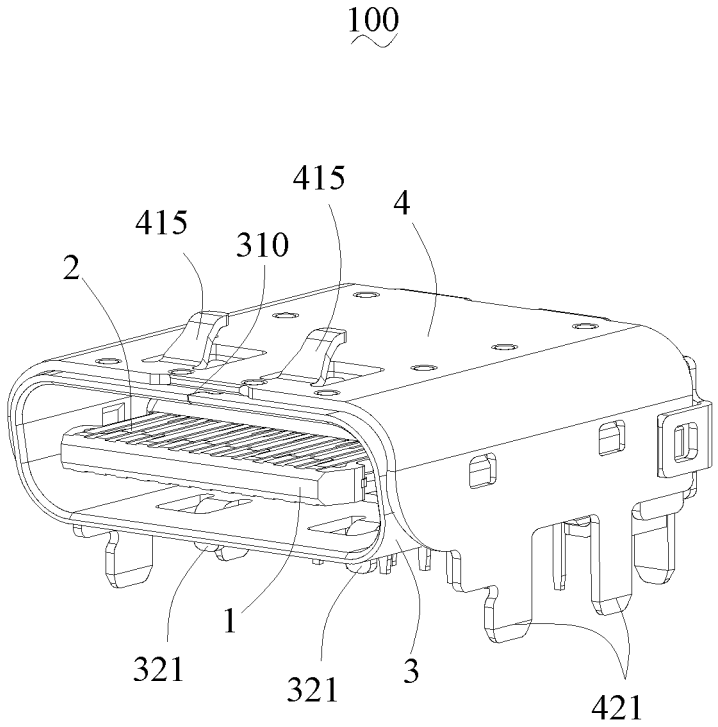
FIG. 1 is a perspective assembled view of an electrical connector in accordance with an embodiment of the present disclosure.
Figure 2:
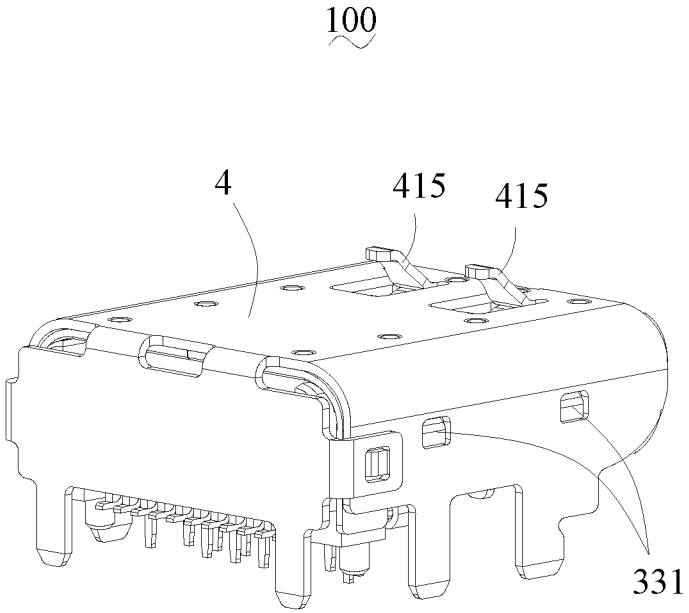
FIG. 2 is a perspective assembled view of the electrical connector of the present disclosure as viewed from another angle.

Please refer to FIGS. 1 to 9, the present disclosure discloses an electrical connector 100 which is mounted on a printed circuit board 200. The electrical connector 100 comprises an insulating body 1, a plurality of conductive terminals 2 disposed in the insulating body 1, a metal inner shell 3 enclosing the insulating body 1, and a metal outer shell 4 covering the metal inner shell 3. The metal inner shell 3 includes a top wall 31, a bottom wall 32 and two side walls 33 connecting the top wall 31 and the bottom wall 32. The top wall 31, the bottom wall 32 and the two side walls 33 enclose a receiving space 30 for receiving a mating connector (not shown). The metal outer shell 4 includes a base portion 41 and two side portions 42 bending and extending downwardly from two side edges of the base portion 41. The base portion 41 is attached and welded to the top wall 31. The top wall 31 is provided with a rivet line 310. By setting the rivet line 310 on the top wall 31 of the metal inner shell 3, the risk of cracking of the metal inner shell 3 is avoided, and the structure of the electrical connector 100 is ensured to be stable and not easily damaged. In accordance with an illustrated embodiment of the present disclosure, the top wall 31 includes a first portion 311 and a second portion 312. The first portion 311 and the second portion 312 are riveted along the rivet line 310 so that the first portion 311 and the second portion 312 are fixed together. The base portion 41 is attached to the first portion 311 and the second portion 312 in order to prevent the first portion 311 and the second portion 312 from splitting relative to each other.

Figure 4:
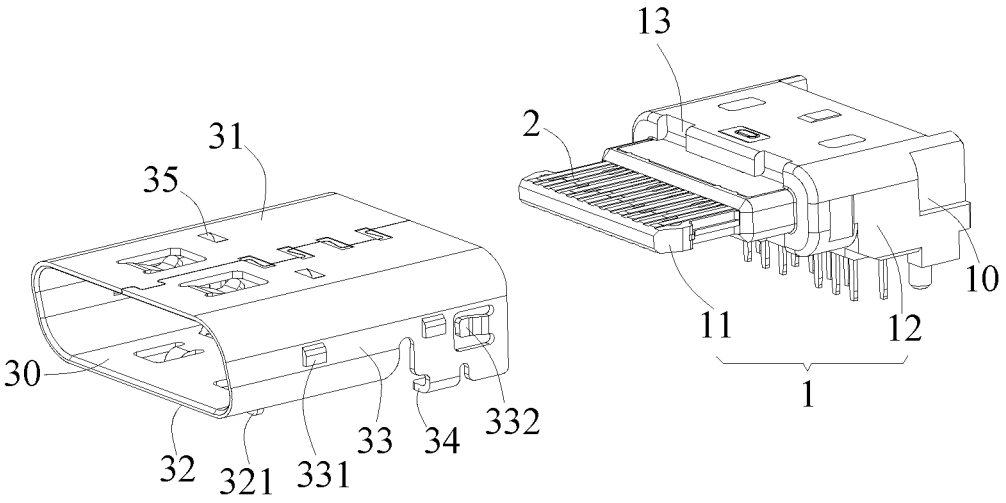
FIG. 4 is a further exploded perspective view of FIG. 3.
Figure 9:
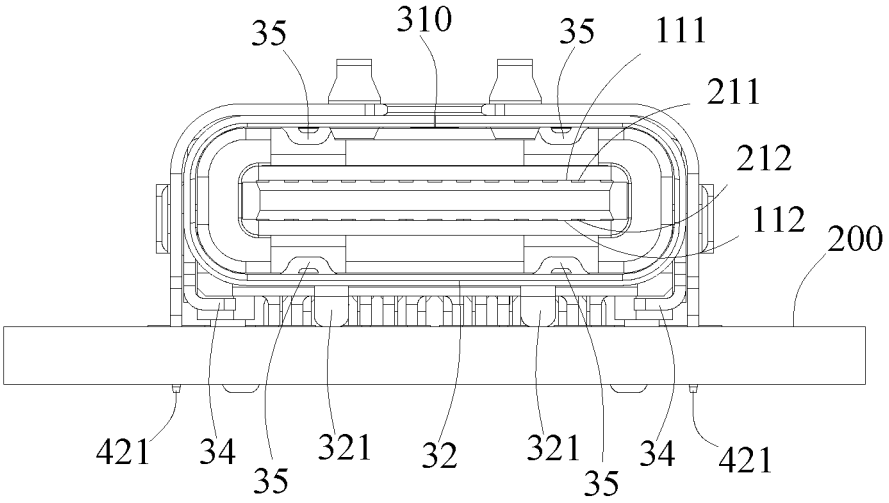
FIG. 9 is a front view of the present disclosure of the electrical connector which is mounted on the printed circuit board.

Please refer to FIGS. 1, 4 and 9, the metal inner shell 3 is provided with two supporting legs 321 which are bent downwardly toward the printed circuit board 200. One end of each supporting leg 321 is connected to the bottom wall 32, and the other end is punched to form a free end from the bottom wall 32. The free end of the supporting leg 321 is capable of abutting an upper surface of the printed circuit board 200. The supporting legs 321 only extend to the upper surface of the printed circuit board 200 so that they can abut against the printed circuit board 200. The purpose by having the supporting legs 321 abutted against the upper surface of the printed circuit board 200 is to enhance the structural strength of the electrical connector 100. By having the supporting legs 321 stamped from the bottom wall 32, the manufacture cost can be saved.

Figure 3:
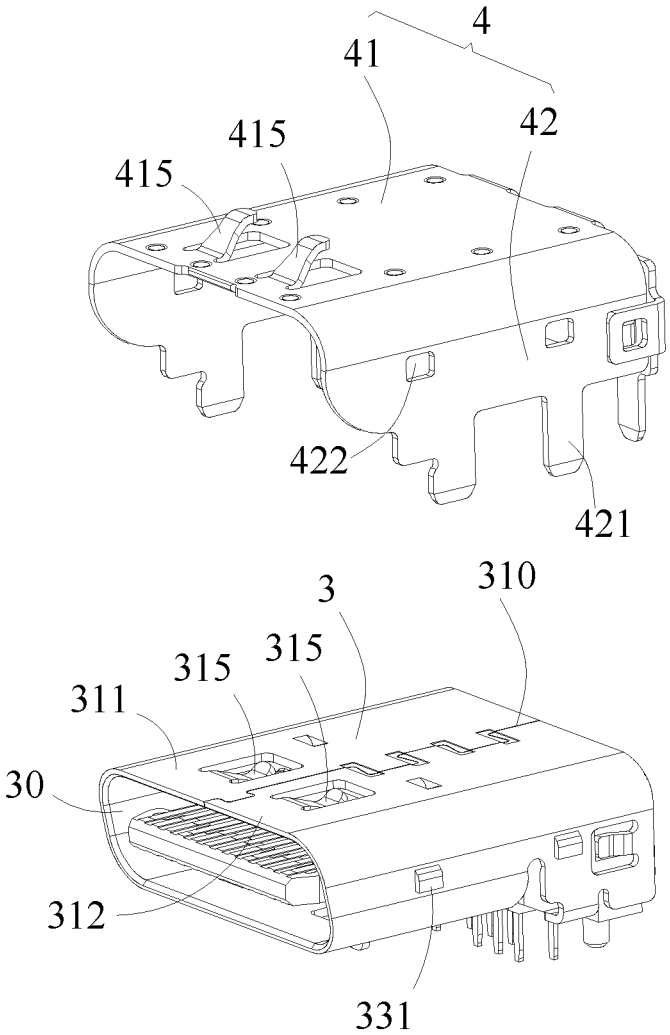
FIG. 3 is a partial exploded view of the electrical connector of the present disclosure.

Please refer to FIGS. 1, 3 and 9, the two side portions 42 are respectively located on outer sides of the two side walls 33. Each side portion 42 extends downwardly to form a mounting leg 421 mounted to the printed circuit board 200. The free end of the supporting leg 321 is higher than the free end of the mounting leg 421. In other words, the mounting leg 421 extends downwardly beyond the free end of the supporting leg 321. The function of the mounting leg 421 is to secure the entire electrical connector 100 to the printed circuit board 200. The supporting leg 321 is only supported between the bottom wall 32 and the printed circuit board 200. Therefore, the extension length of the mounting leg 421 is greater than that of the supporting leg 321. The length of the mounting leg 421 should be able to extend downwardly from the upper surface of the printed circuit board 200 into the interposer hole of the printed circuit board 200.

Please refer to FIGS. 2 to 4 and FIG. 8, one of the side wall 33 and the side portion 42 is provided with a buckle protrusion 331, and the other of the side wall 33 and the side portion 42 is provided with an opening 422. The buckle protrusion 331 is received in the opening 422 in order to secure the metal inner shell 3 and the metal outer shell 4. During the assembly process, the metal inner shell 3 and the metal outer shell 4 achieve pre-positioned via the cooperation between the buckle protrusion 331 and the opening 422. By this pre-positioning method, the locking between the metal inner shell 3 and the metal outer shell 4 is tighter, so that laser welding spots of the metal inner shell 3 and the metal outer shell 4 can be beautiful and the welding force is better, whereby reducing the defects caused by spot welding breakdown.

Figure 5:
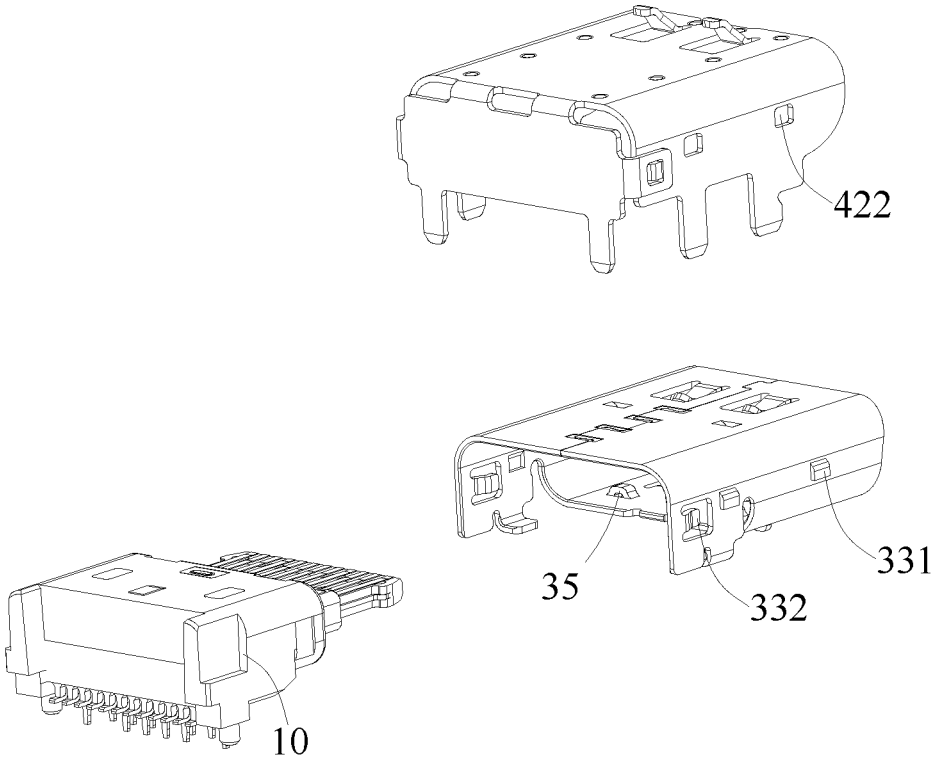
FIG. 5 is an exploded perspective view of the electrical connector of the present disclosure from another angle.

Please refer to FIGS. 3 to 5, side walls 33 of the metal inner shell 3 are provided with a pair of elastic arms 332 protruding toward the insulating body 1. Each side of the insulating body 1 is provided a recess 10, and the elastic arms 332 are elastically held in the recesses 10. In the process of assembling the insulating body 1 and the metal inner shell 3, inserting the insulating body 1 into the metal inner shell 3 along a front-rear mating direction. The elastic arms 332 of the metal inner shell 3 are locked in the recesses 10 of the insulating body 1 so that the insulating body 1 can be assembled to the metal inner shell 3 in a single step.

Referring to FIGS. 4 and 9, the side wall 33 of the metal inner shell 3 includes a bottom plate 34 bent inwardly from a bottom edge of the side wall 33. The bottom plate 34 is located behind the bottom wall 32. The insulating body 1 includes a front tongue plate 11 and a body portion 12 integrally extending rearwardly from the tongue plate 11. The thickness of the body portion 12 is greater than the thickness of the tongue plate 11. The distance between the bottom plate 34 and the top wall 31 is greater than the distance between the bottom wall 32 and the top wall 31. The bottom wall 32 is located below the tongue plate 11, and the bottom plate 34 abuts against a lower side of the body portion 12. That is, front and rear side of the electrical connector 100 are supported by the bottom wall 32 and the bottom plate 34, respectively. The tongue plate 11 has a first surface 111 (i.e., an upper surface) and a second surface 112 (i.e., a lower surface) opposite to the first surface 111.

Referring to FIGS. 4 and 9, a plurality of grooves 13 are formed between the tongue plate 11 and the body portion 12.

Each of the top wall 31 and the bottom wall 32 of the metal inner shell 3 is provided with a plurality of arched portions 35 protruding into the receiving space 30. The arched portions 35 are received in the grooves 13. The cooperation between the arched portions 35 and the grooves 13 ensures that when the insulating body 1 and the metal inner shell 3 are assembled in place, the elastic arms 332 just abut against the recesses 10 by elastic force, so as to form a stable assembly between the insulating body 1 and the metal inner shell 3.

Figure 6:
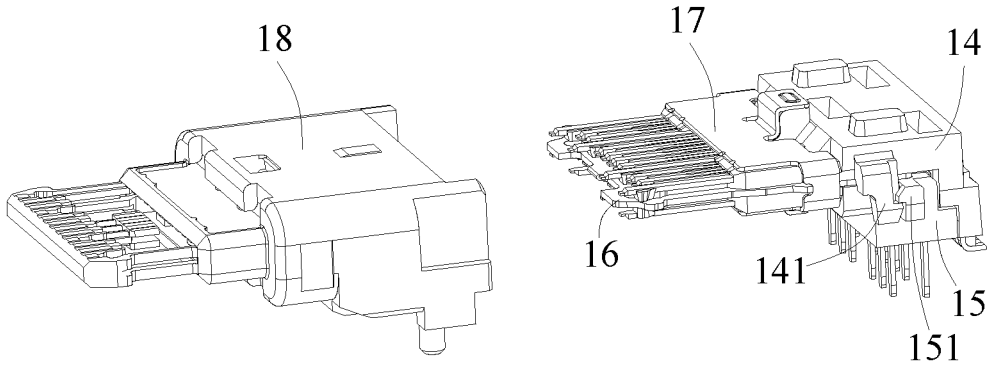
FIG. 6 is a partial exploded view of an insulating body of the electrical connector of the present disclosure.
Figure 7:
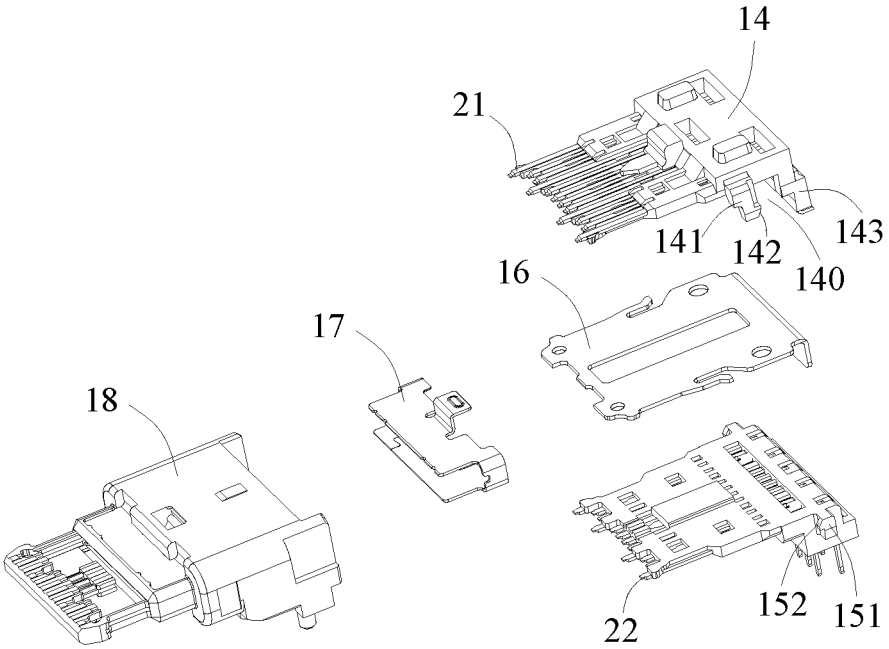
FIG. 7 is a further exploded perspective view of FIG. 6.

Please refer to FIGS. 6 and 7, the insulating body 1 includes a first insulating portion 14 and a second insulating portion 15 on which the first insulating portion 14 is stacked. The conductive terminals 2 include a plurality of first conductive terminals 21 disposed in the first insulating portion 14 and a plurality of second conductive terminals 22 disposed in the second insulating portion 15. The plurality of first conductive terminals 21 have a plurality of flat first contact portions 211 exposed on the first surface 111 and the plurality of second conductive terminals 22 have a plurality of flat second contact portions 212 exposed on the second surface 112. Two outer sides of the first insulating portion 14 are respectively provided with a pair of first hook portions 141 extending toward the second insulating portion 15, and two outer sides of the second insulating portion 15 are respectively provided with a pair of first extending portions extending toward the first insulating portion 14. The first hook portions 141 and the second hook portions 151 are engaged with each other.

Please refer to FIG. 7, furthermore, a head of the first hook portion 141 is provided with an obliquely extending first guide portion 142, and a head of the second hook portion 151 is provided with an obliquely extending second guide portion 152. The first guide portion 142 and the second guide portion 152 cooperate with each other to guide and achieve the engaged relationship between the first hook portion 141 and the second hook portion 151.

Please continue to refer to FIGS. 6 and 7, the first insulating portion 14 includes a rear stop portion 143 extending downwardly from a tail end and abutting against the rear of the second insulating portion 15. An accommodation space 140 is formed between the first hook portion 141 and the rear stop portion 143. The second insulating portion 15 is partially embedded in the accommodation space 140. That is to say, the first and second insulating portions 11 and 12 are designed to be "convex and concave" configurations which match with each other, and the assembly uses interlocking hooks, which can make the assembly stress evenly, enhance the stability of the buckle, and not easily loosen.

Figure 8:
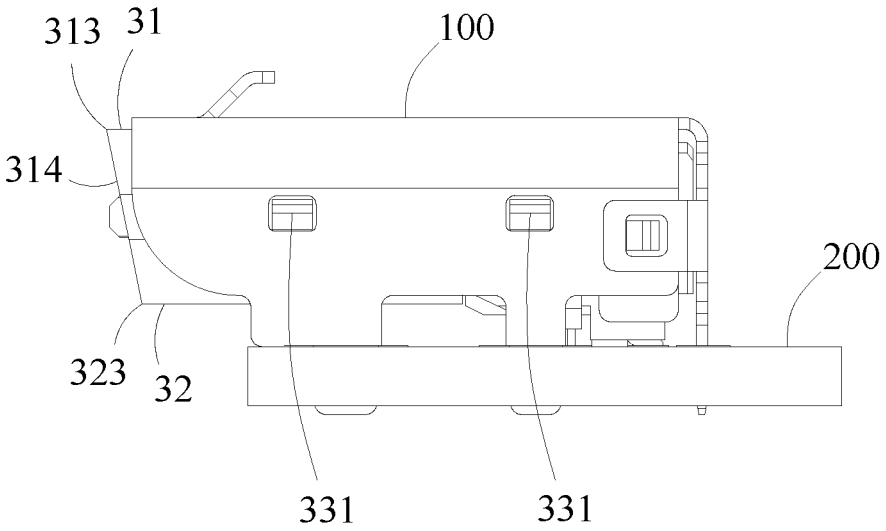
FIG. 8 is a side view of the electrical connector of the present disclosure which is mounted on a printed circuit board.

Please refer to FIG. 8, in a preferred embodiment of the present disclosure, the tongue plate 11 extends forwardly and is exposed in the receiving space 30. This arrangement effectively reduces the length of the electrical connector 100. When the electrical connector 100 is secured to an electronic device (not shown), the length occupied in the mating direction is shortened to facilitate the layout and installation of other components, thereby facilitating the miniaturization and thinning of the electronic device.

In addition, in the front-rear mating direction, front ends of the top wall 31 and the bottom wall 32 of the metal inner shell 3 are provided with a non-flush bevel configuration. With this design, one purpose is aesthetics, and the other is to realize poke-yoke. Therefore, it is not necessary to provide openings or other structural matching designs in the metal inner shell 3 to ensure that the mating connector can be docked correctly. As shown in FIG. 8, the top wall 31 has a top front edge 313, the bottom wall 32 has a bottom front edge 323, and the top front edge 313 protrudes forwardly with respect to the bottom front edge 323 so that a connector port 314 of the metal inner shell 3 is inclined from a side view of the metal inner shell 3.

Please refer to FIGS. 6 and 7, the electrical connector 100 of the present disclosure further includes a metal middle partition plate 16 sandwiched between the first insulating portion 14 and the second insulating portion 15, and a metal shielding sleeve 17 sleeved on the first insulating portion 14 and the second insulating portion 15. The insulating body 1 further includes a first insulating housing 18 over-molding the first insulating portion 14, the second insulating portion 15, the metal middle partition plate 16 and the metal shielding sleeve 17 so that these components are unified as one piece. Besides, the top wall 31 is provided with a pair of lower springs 315 protruding into the receiving space 30. The base portion 41 is provided with a pair of upper springs 415 protruding upwardly from the base portion 41. Both the lower springs 315 and the upper springs 415 extend along the front-rear mating direction. The lower springs 315 are adapted for mating with the mating connector, not only for providing a relative large clamp force to hold the mating connector, but also for providing a good grounding purpose. The upper springs 415 are adapted for engaging with other components for mounting purpose and/or grounding purpose.

By setting the rivet line 310 on the top wall 31 of the metal inner shell 3, the present disclosure avoids the risk of cracking of the metal inner shell 3, and ensures that the structure of the electrical connector 100 is stable and not easily damaged.

The above embodiments are only used to illustrate the present disclosure and not to limit the technical solutions described in the present disclosure. The understanding of this specification should be based on those skilled in the art. Descriptions of directions, such as "front", "back", "left", "right", "top" and "bottom", although they have been described in detail in the above-mentioned embodiments of the present disclosure, those skilled in the art should understand that modifications or equivalent substitutions can still be made to the application, and all technical solutions and improvements that do not depart from the spirit and scope of the application should be covered by the claims of the application.

What is claimed is:

1. An electrical connector adapted to be mounted on a printed circuit board, the electrical connector comprising:

an insulating body;

a plurality of conductive terminals disposed in the insulating body;

a metal inner shell enclosing the insulating body, the metal inner shell comprising a top wall, a bottom wall and two side walls connecting the top wall and the bottom wall so as to form a receiving space to mate with a mating connector; and a metal outer shell covering the metal inner shell, the metal outer shell comprising a base portion and two side portions bent downwardly from two sides of the base portion;

wherein the base portion is attached and welded to the top wall;

wherein the metal inner shell comprises a supporting leg bent downwardly, one end of the supporting leg is connected to the bottom wall and the other end is punched to form a free end with the bottom wall, the free end of the supporting leg is against and supported by an upper surface of the printed circuit board but does not extend through the printed circuit board;

wherein the insulating body comprises a first insulating portion and a second insulating portion on which the first insulating portion is stacked, the conductive terminals comprising a plurality of first conductive terminals disposed in the first insulating portion and a plurality of second conductive terminals disposed in the second insulating portion, two outer sides of the first insulating portion being provided with a pair of first hook portions extending toward the second insulating portion, two outer sides of the second insulating portion being provided with a pair of second hook portions extending toward the first insulating portion, the first hook portions and the second hook portions being engaged with each other;

wherein a head of each first hook portion is provided with an oblique first guide portion, a head of each second hook portion is provided with an oblique second guide portion, and the oblique first guide portion and the oblique second guide portion cooperate with each other so that the first hook portions and the second hook portions can be guided and engaged with each other; and wherein the first insulating portion comprises a rear stop portion extending downwardly from a tail end thereof and abutting against a rear side of the second insulating portion, an accommodation space is formed between the first hook portion and the rear stop portion, and the second insulating portion is partially embedded in the accommodation space.

2. The electrical connector according to claim 1, wherein the two side portions are located outside of the two side walls and each side portion comprises a mounting leg extending downwardly to be mounted to the printed circuit board, the free end of the supporting leg being higher than an end portion of the mounting leg.

3. The electrical connector according to claim 2, wherein one of the side wall and the side portion is provided with a buckle protrusion, and the other of the side wall and the side portion is provided with an opening to receive the buckle protrusion so that the metal inner shell and the metal outer shell are positioned.

4. The electrical connector according to claim 1, wherein the insulating body comprises a recess provided on each side thereof, and the side walls of the metal inner shell are provided with a pair of elastic arms protruding toward the insulating body and elastically abutting against the two recesses, respectively.

5. The electrical connector according to claim 4, wherein the side wall of the metal inner shell comprises a bottom plate bent inwardly from a bottom edge of the side wall, the bottom plate being located behind the bottom wall, the insulating body comprising a tongue plate and a body portion extending rearwardly from the tongue plate, the thickness of the body portion being greater than the thickness of the tongue plate, the distance between the bottom plate to the top wall being greater than the distance between the bottom wall and the top wall, the bottom wall being located below the tongue plate, the bottom plate abutting against a lower side of the body portion.

6. The electrical connector according to claim 5, wherein a plurality of grooves are formed between the tongue plate and the body portion, each of the top wall and the bottom wall of the metal inner shell is provided with a plurality of arched portions protruding into the receiving space, and the arched portions are received in the grooves.

7. An electrical connector comprising:

an insulating body comprising a tongue plate, the tongue plate having a first surface and a second surface opposite to the first surface;

a plurality of conductive terminals disposed in the insulating body, the conductive terminals comprising a plurality of first conductive terminals having a plurality of flat first contact portions exposed on the first surface and a plurality of second conductive terminals having a plurality of flat second contact portions exposed on the second surface; and a metal shell enclosing the insulating body, the metal shell comprising a top wall, a bottom wall and two side walls connecting the top wall and the bottom wall so as to form a receiving space to mate with a mating connector, the tongue plate extending into the receiving space;

wherein the top wall comprises a top front edge, the bottom wall comprises a bottom front edge, and the top front edge protrudes forwardly with respect to the bottom front edge so that a connector port of the metal shell is inclined from a side view of the metal shell;

wherein the metal shell comprises a supporting leg punched downwardly from the bottom wall, the supporting leg has a free end that is adapted to abut against and be supported by an upper surface of a printed circuit board, and the supporting leg does not extend through the printed circuit board;

wherein the insulating body comprises a first insulating portion and a second insulating portion on which the first insulating portion is stacked, the plurality of first conductive terminals being disposed in the first insulating portion, the plurality of second conductive terminals being disposed in the second insulating portion, two outer sides of the first insulating portion being provided with a pair of first hook portions extending toward the second insulating portion, two outer sides of the second insulating portion being provided with a pair of second hook portions extending toward the first insulating portion, the first hook portions and the second hook portions being engaged with each other;

wherein a head of each first hook portion is provided with an oblique first guide portion, a head of each second hook portion is provided with an oblique second guide portion, and the oblique first guide portion and the oblique second guide portion cooperate with each other so that the first hook portions and the second hook portions can be guided and engaged with each other; and wherein the first insulating portion comprises a rear stop portion extending downwardly from a tail end thereof and abutting against a rear side of the second insulating portion, an accommodation space is formed between the first hook portion and the rear stop portion, and the second insulating portion is partially received in the accommodation space.

8. The electrical connector according to claim 7, further comprising a metal outer shell covering the metal shell, the metal outer shell comprising a base portion and two side portions bent downwardly from two sides of the base portion;

wherein the top wall comprises a first portion and a second portion, the first portion and the second portion being riveted along a rivet line to be fixed together, the base portion being attached to the first portion and the second portion in order to prevent the first portion and the second portion from splitting relative to each other.

9. The electrical connector according to claim 8, wherein the base portion is welded to the first portion and the second portion.

10. The electrical connector according to claim 8, wherein the top wall is provided with a pair of lower springs protruding into the receiving space, the base portion is provided with a pair of upper springs protruding upwardly from the base portion, and both the lower springs and the upper springs extend along a front-rear mating direction.

11. The electrical connector according to claim 8, wherein one of the side wall and the side portion is provided with a buckle protrusion, and the other of the side wall and the side portion is provided with an opening to receive the buckle protrusion so that the metal shell and the metal outer shell are positioned.

12. The electrical connector according to claim 7, wherein the two side portions are located outside of the two side walls and each side portion comprises a mounting leg extending downwardly to be mounted to the printed circuit board, the mounting leg extends downwardly beyond the free end of the supporting leg.

* * * * *